US012173629B2

(12) United States Patent
Thirumoolan et al.

(10) Patent No.: US 12,173,629 B2
(45) Date of Patent: Dec. 24, 2024

(54) ROCKER ARM ASSEMBLY WITH MAIN ROCKER AND FORKED AUXILIARY ROCKER

(71) Applicant: Eaton Intelligent Power Limited, Dublin (IE)

(72) Inventors: Manickavasagan Thirumoolan, Tamil Nadu (IN); Chinmaya Chetan, Karnataka (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/417,746

(22) Filed: Jan. 19, 2024

(65) Prior Publication Data

US 2024/0151167 A1 May 9, 2024

Related U.S. Application Data

(63) Continuation of application No. PCT/EP2022/025343, filed on Jul. 22, 2022.

(30) Foreign Application Priority Data

Jul. 23, 2021 (IN) ..... 202111033218

(51) Int. Cl.

| | |
|---|---|
| ***F01L 13/00*** | (2006.01) |
| ***F01L 1/18*** | (2006.01) |
| ***F01L 1/46*** | (2006.01) |
| *F01L 13/06* | (2006.01) |

(52) U.S. Cl.

CPC ..... *F01L 13/0036* (2013.01); *F01L 1/181* (2013.01); *F01L 1/46* (2013.01); *F01L 13/0015* (2013.01); *F01L 2001/186* (2013.01); *F01L 2001/467* (2013.01); *F01L 13/06* (2013.01)

(58) Field of Classification Search

CPC ..... F01L 1/181; F01L 2001/186; F01L 1/46; F01L 2001/467; F01L 13/0036; F01L 13/06

USPC ..... 123/90.16, 90.44

See application file for complete search history.

(56) References Cited

FOREIGN PATENT DOCUMENTS

| | | |
|---|---|---|
| DE | 102004043182 A1 | 3/2006 |
| DE | 102011085708 A1 | 5/2013 |
| DE | 102015015087 A1 | 5/2017 |

(Continued)

OTHER PUBLICATIONS

International Search Report and Written Opinion for International Application No. PCT/EP2022/025343, 11 pages.

*Primary Examiner* — Jorge L Leon, Jr.
(74) *Attorney, Agent, or Firm* — Baker Botts L.L.P.

(57) ABSTRACT

A rocker arm assembly can comprise a main rocker, an auxiliary rocker, and a lost motion spring mounted to press on the main rocker and the auxiliary rocker. The main rocker can comprise a main body surrounding a main rocker bore, a valve end, a main cam end, and a main latch bore between the valve end and the main cam end. The auxiliary rocker can comprise an auxiliary body that is forked. A first auxiliary rocker bore and a second auxiliary rocker bore can flank the main rocker bore. A first auxiliary cam end and a second auxiliary cam end can flank the main cam end. A first auxiliary latch bore and a second auxiliary latch bore can flank the main latch bore. The lost motion spring can span over the main latch bore.

20 Claims, 6 Drawing Sheets

(56) References Cited

FOREIGN PATENT DOCUMENTS

| | | | | |
|---|---|---|---|---|
| WO | WO 2006090292 | A2 | 8/2006 | |
| WO | WO-2020030298 | A1 * | 2/2020 | ..... F01L 1/047 |

* cited by examiner

ROCKER ARM ASSEMBLY WITH MAIN ROCKER AND FORKED AUXILIARY ROCKER

PRIORITY

This application is a continuation under 35 U.S.C. § 365 (c) of International Patent Application No. PCT/EP2022/025343, filed 22 Jul. 2022, which claims the benefit under 35 U.S.C. § 119 (a) of India Provisional Patent Application No. 20/2111033218, filed 23 Jul. 2021, which are incorporated herein by reference.

FIELD

This application provides a rocker arm assembly for a center pivot (type III) valvetrain. A divided auxiliary rocker is configured to flank portions of a main rocker to align latch bore portions and rocker bore portions.

BACKGROUND

There can be very limited space in a valvetrain for packaging all of the components. The area above the valve stems and the length along the rocker shaft are two areas with tight packaging constraints. While the prior art teaches the use of dedicated main and auxiliary rocker arms, meaning each rocker arm has its own valve end and cam end, the packaging is difficult. And, material cost and weight for each dedicated main and auxiliary rocker arm is high.

SUMMARY OF PARTICULAR EMBODIMENTS

The methods and devices disclosed herein improve the art by way of a rocker arm assembly can comprise a main rocker, an auxiliary rocker, and a lost motion spring mounted to press on the main rocker and the auxiliary rocker. The main rocker can comprise a main body surrounding a main rocker bore, a valve end, a main cam end, and a main latch bore between the valve end and the main cam end. The auxiliary rocker can comprise an auxiliary body that is forked. A first auxiliary rocker bore and a second auxiliary rocker bore can flank the main rocker bore. A first auxiliary cam end and a second auxiliary cam end can flank the main cam end. A first auxiliary latch bore and a second auxiliary latch bore can flank the main latch bore. The lost motion spring can span over the main latch bore.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1:
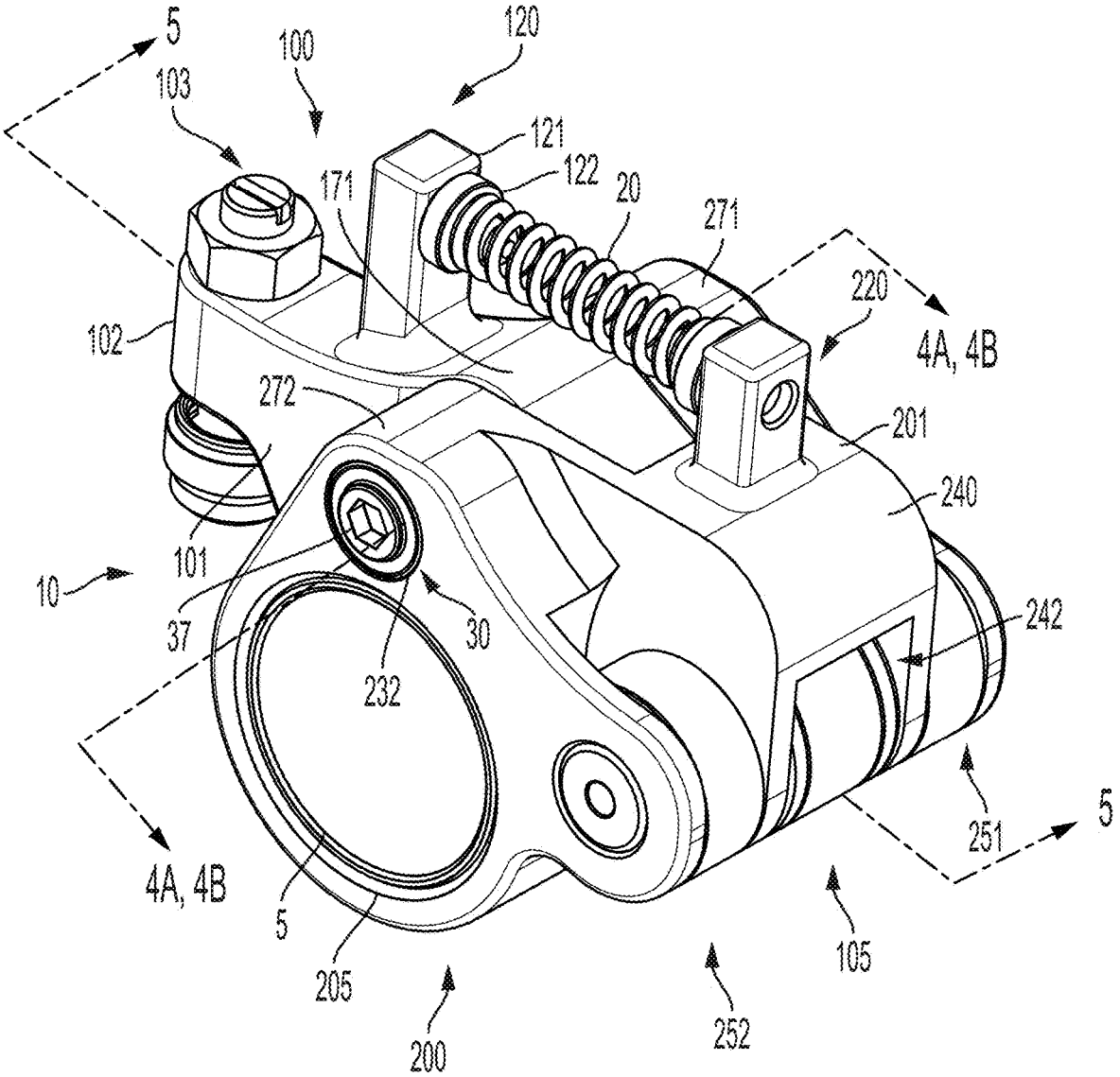
FIG. 1 is a perspective view of a rocker arm assembly.
Figure 2A:
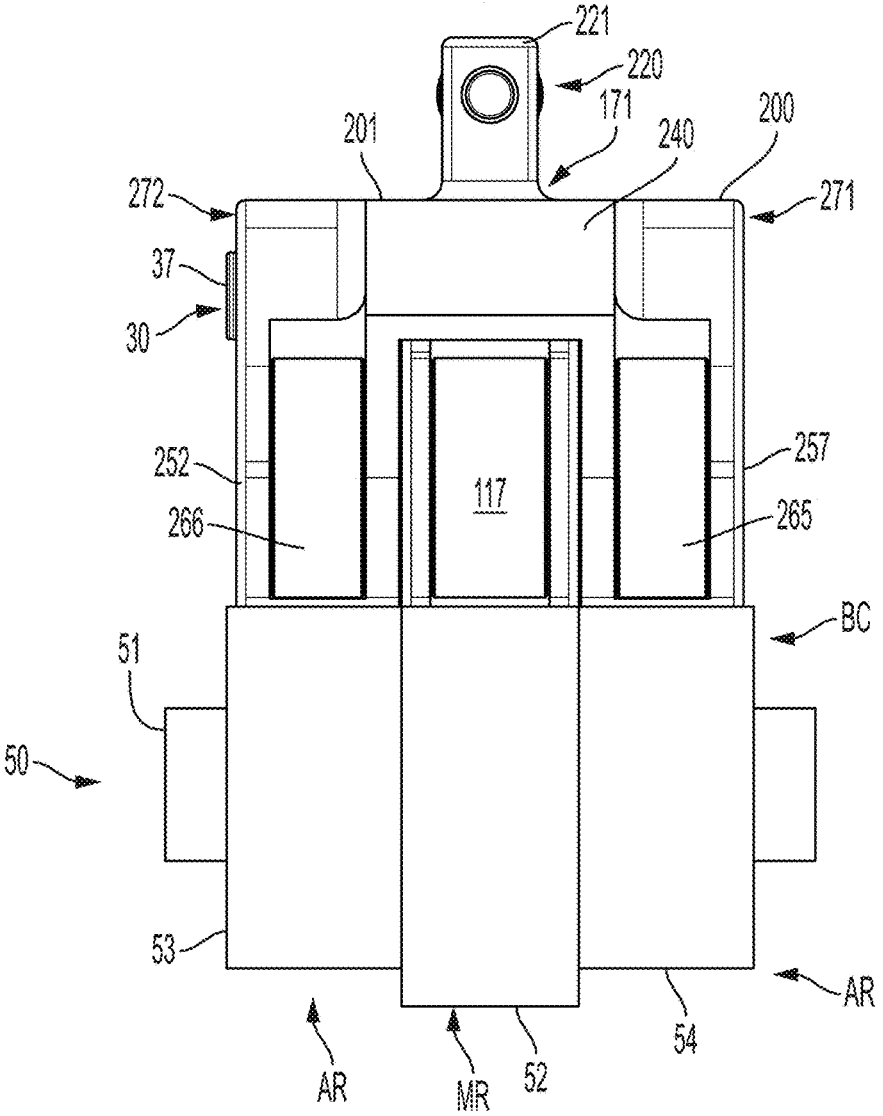
FIG. 2A is a view of the rocker arm assembly relative to an example cam assembly.
Figure 2B:
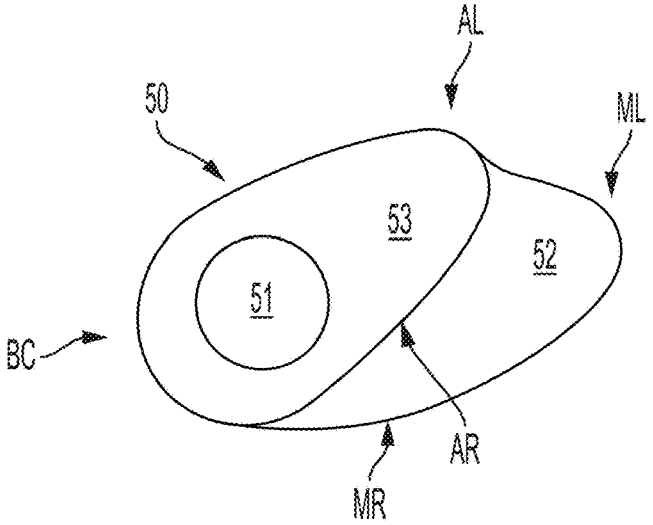
FIG. 2B shows an example cam assembly.
Figure 3:
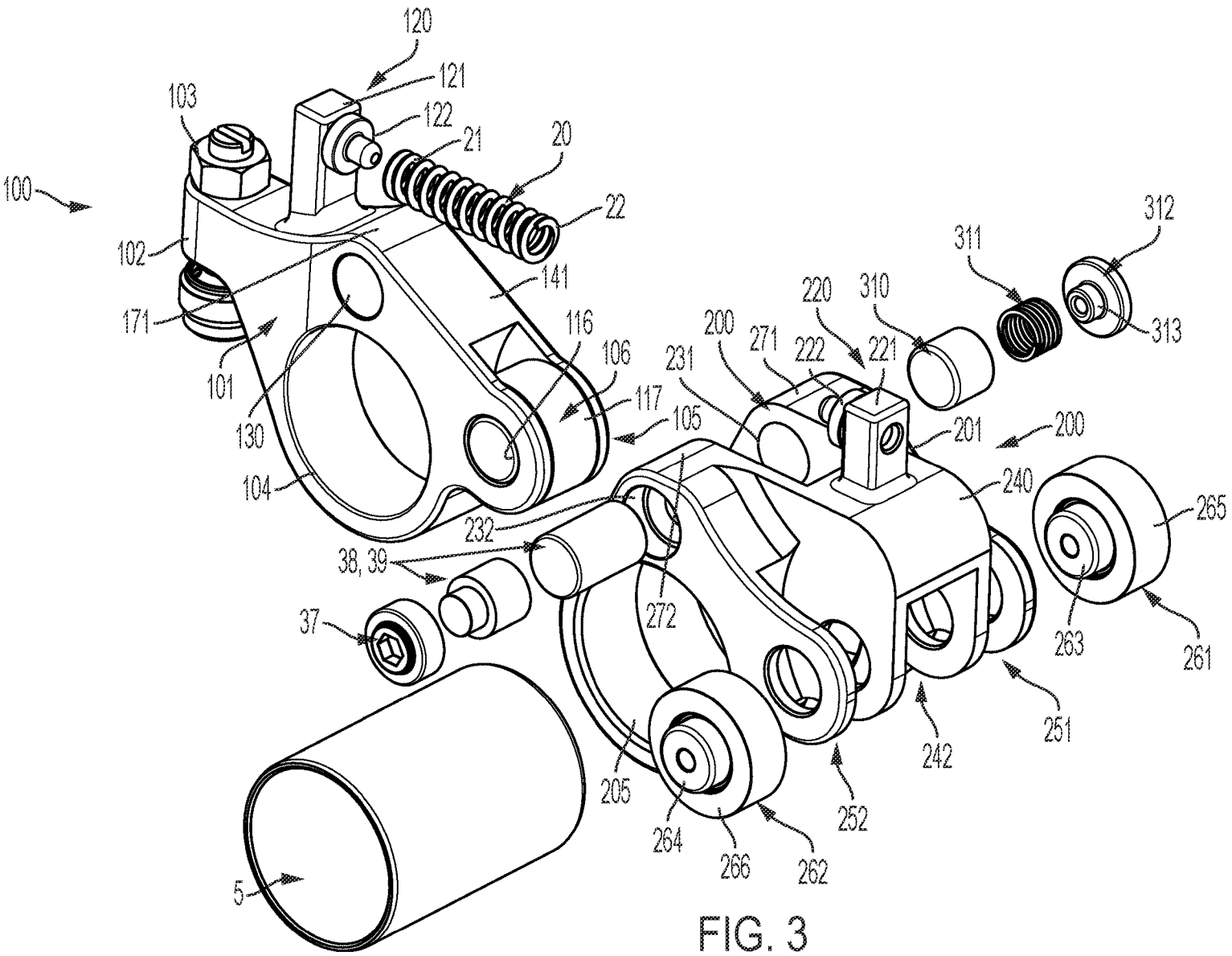
FIG. 3 is an exploded view of the rocker arm assembly.

A rocker arm assembly 10 can be configured with a main rocker 100 and a forked auxiliary rocker 200. The main rocker 100 can be integrated with the auxiliary rocker 200 in a split rocker arm design for main and auxiliary lift functionality. The working examples are directed to switching between engine braking and normal exhaust valve opening, but other kinds of variable valve lift (VVL) can be implemented, such as cylinder deactivation (CDA), early or late intake valve opening or closing (LIVC, EIVO, LIVO, EIVC), early or late exhaust valve opening or closing (EEVC, LEVC, EEVO, LEVO), and combinations thereof. Modifying one or more of the main and auxiliary cam lobes 52-54, main or auxiliary travel limits 141, 241, or main or auxiliary bearing assemblies 106, 261, 262 would enable one of skill in the art to use another VVL other than the working examples.

For a center pivot rocker arm assembly for a type III valve train architecture, an integrated split rocker arm assembly has been devised that can serve the purpose of both engine braking and normal exhaust valve opening (exhaust stroke) with the help of auxiliary cam lobes 53, 54 dedicated for engine braking and a main cam lobe 52 dedicated for normal exhaust valve opening.

Usually there is very limited space towards the valve side of a valvetrain and there is limited space on the rocker shaft to package a dedicated standard exhaust and brake rocker arm. Space, weight, and costs savings can be achieved using the disclosed integrated split rocker concept shown herein. The rocker arm assembly 10 is easier to package as a valvetrain assembly 1. Also, the components of the latch assembly 30 are easier to package than prior art rocker assemblies. Costs and weight are reduced since a dedicated exhaust rocker arm assembly is eliminated. As an optional feature, the main and auxiliary travel limits 141, 241 can be used to form stopping features to align the main and auxiliary rocker arms 100, 200 so that, even during the normal exhaust lift, brake activation/deactivation via the latch assembly 30 is possible during main exhaust event. This improves the response time of actuation & de-actuation. Another benefit of the rocker arm assembly 10 is that no separate lash adjustment for a dedicated engine brake arm is required. A single lash adjuster can be installed as part of capsule 103 or another valvetrain component dedicated to the lash of the rocker arm assembly 10. Capsule 103 in the valve end 102 can be a variety of alternatives, such as a mechanical lash adjuster, a lubricated spigot, a hydraulic lash adjuster, a castellation device, a deactivating latch mechanism among many options for purposes like lash adjustment or variable valve actuation or variable valve lift. The valve end 102 of the main rocker 100 can be the only valve end over the valve stems in the valvetrain, reducing weight and material costs. Also, this rocker arm assembly 10 can take high loads. Hence, it would have high stiffness and fatigue life. The high load bearing can be attributed to the location of the latch assembly 30 and the durable configurations of the main and auxiliary rockers 100, 200. Also, because of the presence of two deactivating arm rollers (first and second auxiliary bearing assemblies 261, 262), the rocker arm assembly 10 can withstand higher cam roller contact stress from the cam assembly 50. Hence, the rocker arm assembly 10 can be used to open both valves in a valve bridge configuration. Then, the rocker arm assembly 10 can be used in valvetrains reaching high peak pressures. Lastly, the design of the forked auxiliary rocker 200 presents a lesser possibility of edge loading at the auxiliary cam lobes 53, 54 during engine braking.

A latch assembly 30 comprising a three-pin configuration can be used for actuating and de-actuating the engine braking. The latch assembly can be installed to actuate along an axis parallel to the main rocker shaft or bush 5, and along an axis parallel to the cam shaft 51. Then, the latch assembly 30 can be said to be configured to actuate in an axis parallel to the main rocker bore 104 and also parallel to the main bearing axle 116. So, it can be said that the latch assembly 30 is installed in the center pivot rocker arm assembly 10 above the bush 5 and below the lost motion spring 20. Or, it can be said that the latch assembly 30 is installed in the center pivot rocker arm assembly 10 above the rocker shaft through-passages (main rocker bore 104 & first and second auxiliary rocker bores 204, 205) and below the lost motion spring 20.

Rocker arm assembly 10 can be a center pivot rocker arm for a valve train architecture 1. Rocker arm assembly 10 can be characterized as a split rocker arm assembly configured to switch between engine braking on the valve train architecture and normal exhaust valve opening on the valve train architecture. The split rocker arm assembly can comprise one or more first cam lobes (auxiliary cam lobes 53, 54) for engine braking and at least one other cam lobe (main cam lobe 52) for normal exhaust valve opening.

Rocker arm assembly 10 can comprise a main rocker 100 comprising a main body 101 surrounding a main rocker bore 104, a valve end 102, a main cam end 105, and a main latch bore 130 between the valve end 102 and the main cam end 105. An auxiliary rocker 200 can configured to nest the main rocker 100. Auxiliary rocker 200 can be said to flank the main rocker 100, as by having forked portions straddling portions of the main rocker 100. Auxiliary rocker 200 can comprise an auxiliary body 201 forked to comprise a first auxiliary rocker bore 204 and a second auxiliary rocker bore 205 flanking the main rocker bore 104. A first auxiliary cam end 251 and a second auxiliary cam end 252 can flank the main cam end 105. A first auxiliary latch bore 231 and a second auxiliary latch bore 232 can flank the main latch bore 130. With the first & second auxiliary latch bores 231, 232 flanking the main latch bore 130 above the first and second auxiliary rocker bores 204, 205 that flank the main rocker bore 104, stable and sure alignment of the latch assembly 30 can be had. The close proximity of the first & second auxiliary latch bores 231, 232 & the main latch bore 130 to the first and second auxiliary rocker bores 204, 205 & main rocker bore 104 means that oil control to any one of the latch bores can be through a short oil feed 214, enabling precise control. So, while a three-pin latch assembly 30 is shown, other latching arrangements spanning three bores can be used with the teachings herein, even if the oil feed 214 is duplicated to both first and second auxiliary latch bores 231, 232 or moved to connect with the main latch bore 130.

Auxiliary rocker 200 can be characterized as a forked outer arm. It can comprise the one or more auxiliary cam lobes 53, 54 for engine braking. The main arm 100 can be nested in the forked outer arm. And, the main arm 100 can comprise the main cam lobe 52 for normal exhaust valve opening. It is possible to use a bush 5 to align the main and auxiliary arm 100, 200. The bush 5 can be configured to seat on a rocker shaft. The bush 5 can comprise one or more oil ports 15 to communicate with one or more oil feeds 214 in the rocker shaft. For example, if capsule 103 is hydraulically controlled or lubricated, an oil port 15 could be formed in the bush 5 to connect with a corresponding oil feed in the main rocker 100.

While it is possible for the main and auxiliary rocker arms 100, 200 to seat directly on a rocker shaft of the valvetrain, it is also possible to press-fit the bush 5 to connect the main and auxiliary rocker arms 100, 200. The bush 5 can be installed through the first auxiliary rocker bore 204, the main rocker bore 104, and the second auxiliary rocker bore 205.

A lost motion spring 20 can be mounted to press on the main rocker 100 and the auxiliary rocker 200. The lost motion spring 20 can span over the main latch bore 130. The lost motion spring 20 can comprise a main end 21 mounted between the valve end 102 and the main latch bore 130 to press on the main rocker 100. In the working example, a main spring mounting assembly 120 is shown to comprise a main spring post 121 and a main guide pin 122. The lost motion spring 20 can also comprise an auxiliary end 22 mounted in a position between the first auxiliary latch bore 231, the second auxiliary latch bore 232, the first auxiliary cam end 251, and the second auxiliary cam end 252. In the working example, an auxiliary spring mounting assembly 220 is shown to comprise an auxiliary spring post 221 and an auxiliary guide pin 222. It is possible to substitute other main and auxiliary spring mounting assemblies to position the lost motion spring 20 in place.

It can be said that the lost motion spring 20 is mounted over a main latch shoulder 171 of the main body 101. Then, a moment of inertia can be balanced over the rocker shaft and optional bush 5 for quicker actuation. The weight of the lost motion spring 20 stacks over the rocker shaft, as does the weight of the latch assembly 30 installed in the main latch bore 130 in the main latch shoulder 171 and installed in the first and second auxiliary latch bores 231, 232 in the auxiliary latch shoulders 271, 272 in the auxiliary body 201.

Figure 5:
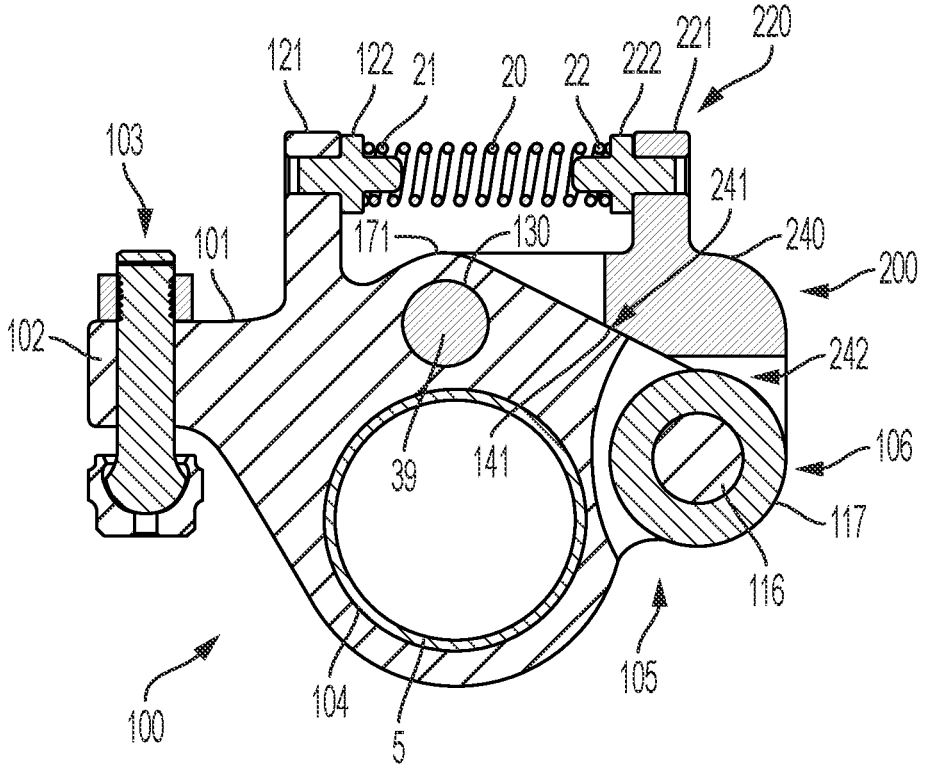
FIG. 5 is an alternative cross-section view showing a travel limit aspect of the rocker arm assembly.

The auxiliary body 201 can comprise a bridge portion 240 configured to span over a portion of the main body 101. The bridge portion 240 can be configured between the first auxiliary cam end 251 and the second auxiliary cam end 252. As illustrated in FIG. 5, the bridge portion 240 can form a travel limit 241 for the main body 101 when the main body 101 is actuated relative to the auxiliary body 201. The bridge portion 240 can form a travel limit 241 to contact a main travel limit 141 in the main body 101. The main travel limit 141 can be a surface between the main latch bore 130 and the main cam end 105. The lost motion spring 20 can be mounted on near the bridge portion 240 to press on the auxiliary rocker 200.

Rocker arm assembly 10 can be characterized as a 3 axle-roller assembly. First and second auxiliary bearing assemblies 261, 262 can be included in the first and second auxiliary cam ends 251, 252. While tappets or slider pads can be used, the working example is shown with first and second auxiliary bearing axles 263, 264 for mounting corresponding first and second auxiliary rollers 265, 266 to the first and second auxiliary cam ends 251, 252. Then, the $3^{rd}$ axle-roller can be the main bearing assembly 106 in main cam end 105. It can also be a tappet or slider pad, but is illustrated with a main bearing axle 116 and main roller 117. Then, as above, the main bearing assembly 106 can receive actuation forces from main cam lobe 52 for a first main lift ML. And, first and second auxiliary bearing assemblies 261, 262 can receive auxiliary actuation forces from auxiliary cam lobes 53, 54 for an auxiliary lift AL. The profile of the main and auxiliary cam lobes 52-54 can vary from that drawn to suit the VVL operational modes selected. After rotating through main lift ML and or auxiliary lift AL, main release MR and auxiliary release AR profiles can follow against the main and auxiliary bearing assemblies 106, 261, 262 to return to a base circle BC profile. The base circle BC profile can align all of the main and auxiliary latch bores 130, 231, 232 for easy actuation of the latch assembly 30.

The latch assembly 30 being a 3-pin configuration, it is possible to switch between an unlatched condition and a latched condition. In the unlatched condition, each of the latch pin 310, center pin 39, and latch piston 38 are configured so that the auxiliary arm 200 can move relative to the main arm 100. In the latched condition, the latch pin 310, center pin 39, and latch piston 38 can be configured so that two of them connect the auxiliary arm 200 and main arm 100 for rotation together. In the working example, the unlatched condition can provide normal exhaust valve lift while the latched condition can provide exhaust valve braking that optionally transitions to a normal exhaust valve lift or that optionally excludes the normal exhaust valve lift, as designed into the main and auxiliary travel limits 141, 241, main and auxiliary cam lobes 52-54, and main and auxiliary rollers 117, 265, 266.

Latch assembly 30 can comprise a latch pin 310 installed in the first auxiliary latch bore 231, a center pin 39 installed in the main latch bore 130, and a latch piston 38 installed in the second auxiliary latch bore 232. An actuation seal 312 can also be installed in the first auxiliary latch bore 231. The actuation seal 312 can be configured to enclose the latch pin 310 in the first auxiliary latch bore 231. As options, a spring guide 313 and leak down port can be included on the actuation seal 312. Then, an actuation spring 311 can be installed between the actuation seal 312 and the latch pin 310. The optional spring guide 313 can serve as a travel limit for the latch pin 310 or it could prevent over-compression of the actuation spring 311. While a coil spring is shown, actuation spring 311 can be another kind of bias mechanism, such as a leaf spring, wave spring, or compressible chamber.

A seal 37 can be installed in the second auxiliary latch bore 232. The seal 37 can be configured to enclose the latch piston 38 in the second auxiliary latch bore 232. The seal can be a threaded seal that can be threaded in place to custom-align the members of the latch assembly 30. Other options, such as press-fitting or welding, are not excluded. So, seal 37 and second auxiliary latch bore 232 can comprise mating threads to position seal 37.

Latch piston 38 can comprise a guide post 381 configured as a step-down. While not limited to cylindrical pins, in the working example, the step-down results in a diameter change from a larger diameter head of the latch piston 38 to a narrower diameter neck forming the guide post 381. The guide post 381 abuts the seal 37 when the latch assembly 30 is in the unlatched condition. But, controlling an oil pressure against the latch piston 38 can slide the latch piston away from the seal 37 to engage the latch piston 38 in both the main latch bore 130 and the second auxiliary latch bore 232. The center pin 39 consequently slides to engage in both main latch bore 130 and the first auxiliary latch bore 231. The latch pin 310 consequently compresses the actuation spring 311 and moves towards the actuation seal 312.

To enable the actuation of the latch assembly 30, the working example comprises an oil feed 214 in the auxiliary body 201. The oil feed 214 is configured to fluidly connect the second auxiliary latch bore 232 with the second auxiliary rocker bore 205. The oil feed 214 can be configured to supply actuation oil to the guide post 381. The guide post 381 can prevent the latch piston 38 from being pressed by the actuation spring 311 too far against the seal 37. And, the diameter change of the guide post 381 can form space for an oil cavity for the actuation oil to accumulate in second auxiliary latch bore 232 for the actuation of the latch assembly 30.

Figure 4A:
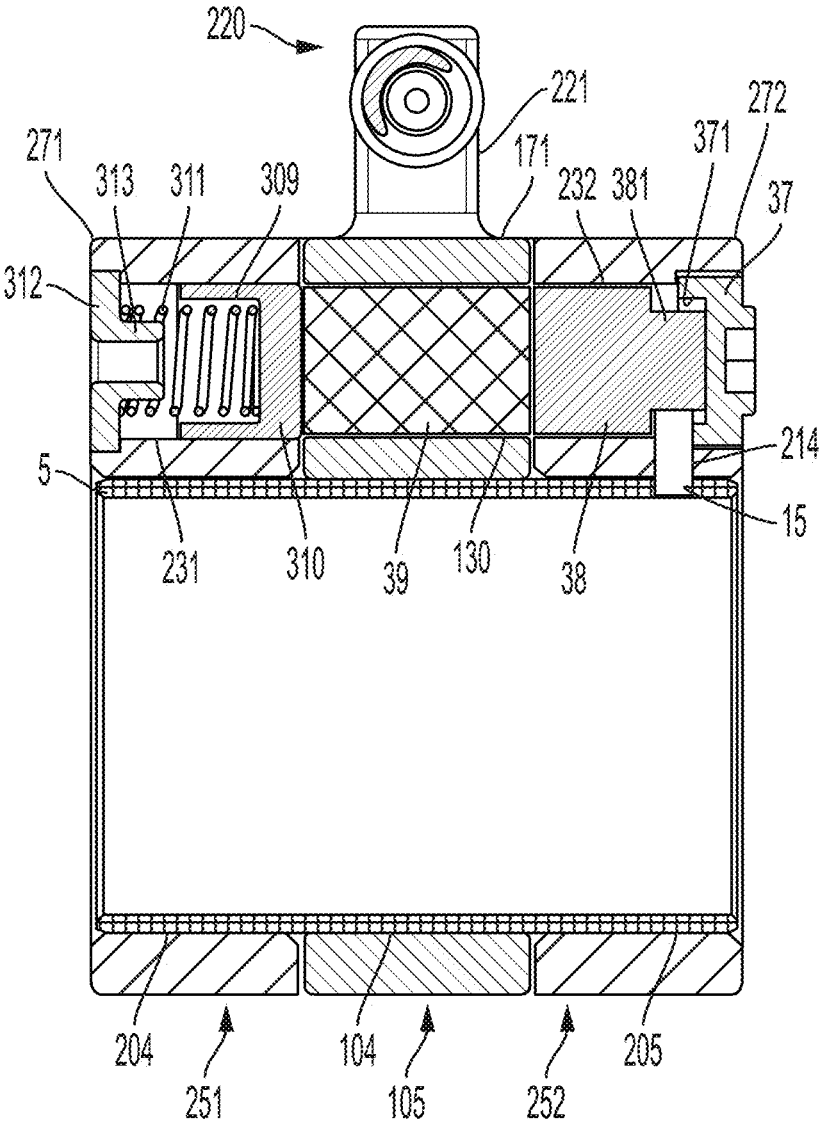
FIG. 4A is a cross-section view showing an unlatched latch assembly.

In FIG. 4A the rocker arm assembly 10 is shown in an unlatched condition. There is no oil supply to oil feed 214. Both the main and auxiliary arms 100, 200 are disconnected from each other, as the members of the latch assembly 30 lay wholly in their corresponding bores. The auxiliary valve lift, in this example engine braking, is deactivated. While the auxiliary lobes 53, 54 will press on the auxiliary arm 200 to rotate it, the auxiliary lift AL will not transfer to the valve end 102. Instead, the auxiliary arm 200 will compress the lost motion spring 20. However, the main lift ML portion of the main cam lobe 52 can be configured to press on the main arm 100 subsequent to the lost motion stroke. Then, the main lift ML will move the valve end 102. As an option, the stopping features formed by the main and auxiliary travel limits 141, 241 can cause the auxiliary arm 200 to travel with the main arm 100 for some portion of the main lift ML. The main and auxiliary travel limits 141, 241 can be used to ensure that the latch assembly 30 aligns during base circle BC for switching between latched and unlatched conditions or to ensure that the lost motion spring 20 forces are in check.

Figure 4B:
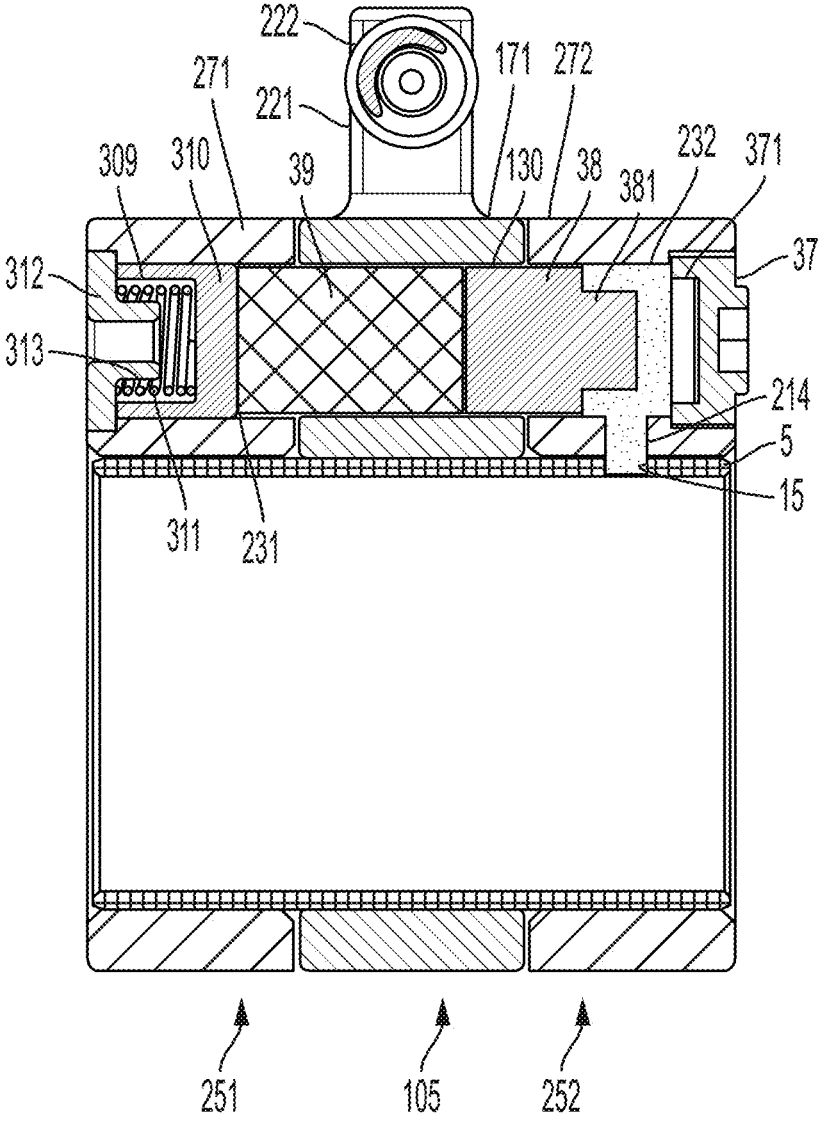
FIG. 4B is a cross-section view showing a latched latch assembly.

The rocker arm assembly 10 can be seen with engine braking activated in FIG. 4B. Actuation oil can be supplied to the oil feed 214 to push latch piston 38 away from latch seal 37 as discussed above. The main and auxiliary arms 100, 200 are connected via the latch assembly 30. Now the auxiliary lift AL portion of the auxiliary cam lobes 53, 54 presses on the auxiliary arm 100 and the valve end 102 actuates because the main arm 100 moves with the auxiliary arm 200. Then, as the cam shaft 51 rotates, the main lift ML portion of the main cam lobe 52 presses on the main arm 100 to further actuate the valve end 102. The main and auxiliary travel limits 141, 241 can cooperate so that even if the auxiliary lift lobe AL does not move the auxiliary arm 200 according to a lift profile, the auxiliary arm 200 is connected to the main arm 100 via the stopping feature and the auxiliary arm 200 can move according to the profile of the main lift ML portion.

Other implementations will be apparent to those skilled in the art from consideration of the specification and practice of the examples disclosed herein.

What is claimed is:

1. A rocker arm assembly, comprising:

a main rocker including a main body extending between a valve end and a main cam end of the main rocker, the main body defining:

a main rocker bore; and a main latch bore arranged above the main rocker bore between the valve end and the main cam end;

an auxiliary rocker with a forked auxiliary body including:

a first auxiliary rocker bore and a second auxiliary rocker bore cooperating so as to coaxially flank the main rocker bore;

a first auxiliary cam end and a second auxiliary cam end cooperating so as to coaxially flank the main cam end; and a first auxiliary latch bore and a second auxiliary latch bore respectively arranged above the first auxiliary rocker bore and the second auxiliary rocker bore so as to coaxially flank the main latch bore; and a lost motion spring pressed between the main rocker and the auxiliary rocker, the lost motion spring extending over the main latch bore.

2. The rocker arm assembly of claim 1, wherein the lost motion spring includes a main end mounted to the main rocker at a position between the valve end and the main latch bore.

3. The rocker arm assembly of claim 2, wherein the lost motion spring further includes an auxiliary end mounted to the auxiliary rocker at a position between the main latch bore and the main cam end.

4. The rocker arm assembly of claim 1, further comprising a latch assembly, including:

a latch pin arranged in the first auxiliary latch bore;

a center pin arranged in the main latch bore; and a latch piston arranged in the second auxiliary latch bore.

5. The rocker arm assembly of claim 4, further comprising an actuation seal arranged in the first auxiliary latch bore, the actuation seal configured to enclose the latch pin in the first auxiliary latch bore.

6. The rocker arm assembly of claim 5, further comprising an actuation spring arranged in the first auxiliary latch bore between the actuation seal and the latch pin.

7. The rocker arm assembly of claim 4, further comprising a seal arranged in the second auxiliary latch bore, the seal configured to enclose the latch piston in the second auxiliary latch bore.

8. The rocker arm assembly of claim 7, wherein the latch piston includes a guide post formed as a step-down configured to abut the seal.

9. The rocker arm assembly of claim 8, further comprising an oil feed formed in the forked auxiliary body, the oil feed configured to fluidly connect the second auxiliary latch bore to the second auxiliary rocker bore so as to supply actuation oil to the guide post.

10. The rocker arm assembly of claim 7, further comprising an oil feed formed in the forked auxiliary body, the oil feed configured to fluidly connect the second auxiliary latch bore to the second auxiliary rocker bore.

11. The rocker arm assembly of claim 1, wherein the forked auxiliary body further includes a bridge portion configured to extend over a portion of the main body.

12. The rocker arm assembly of claim 11, wherein the bridge portion is arranged between the first auxiliary cam end and the second auxiliary cam end.

13. The rocker arm assembly of claim 11, wherein the bridge portion forms a travel limit for the main body when the main body is actuated relative to the forked auxiliary body.

14. The rocker arm assembly of claim 13, wherein the travel limit is configured to contact the main body between the main latch bore and the main cam end.

15. The rocker arm assembly of claim 11, wherein the lost motion spring is mounted to the bridge portion so as to press on the auxiliary rocker.

16. A rocker arm assembly, comprising:

a main rocker including a main body extending between a valve end and a main cam end of the main rocker, the main body defining:

a main rocker bore; and a main latch bore arranged between the valve end and the main cam end;

an auxiliary rocker with a forked auxiliary body including:

a first auxiliary rocker bore and a second auxiliary rocker bore cooperating so as to coaxially flank the main rocker bore;

a first auxiliary cam end and a second auxiliary cam end cooperating so as to coaxially flank the main cam end; and a first auxiliary latch bore and a second auxiliary latch bore cooperating so as to coaxially flank the main latch bore; and a lost motion spring pressed between the main rocker and the auxiliary rocker, the lost motion spring extending over the main latch bore such that the first and second auxiliary latch bores are vertically positioned between the lost motion spring and the first and second auxiliary rocker bores.

17. The rocker arm assembly of claim 16, wherein the lost motion spring includes a main end mounted to the main rocker at a position between the valve end and the main latch bore.

18. The rocker arm assembly of claim 17, wherein the lost motion spring further includes an auxiliary end mounted to the auxiliary rocker at a position between the main latch bore and the main cam end.

19. The rocker arm assembly of claim 16, further comprising a latch assembly including:

a latch pin arranged in the first auxiliary latch bore;

a center pin arranged in the main latch bore; and a latch piston arranged in the second auxiliary latch bore.

20. The rocker arm assembly of claim 19, further comprising an actuation seal arranged in the first auxiliary latch bore, the actuation seal configured to enclose the latch pin in the first auxiliary latch bore.

* * * * *